US011245213B2

(12) United States Patent
Busies et al.

(10) Patent No.: US 11,245,213 B2
(45) Date of Patent: Feb. 8, 2022

(54) CLEAN BODY ELECTRIC TERMINAL

(71) Applicant: Lear Corporation, Southfield, MI (US)

(72) Inventors: Rainer Busies, Remscheid (DE); Dirk Winter, Remscheid (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/984,674

(22) Filed: Aug. 4, 2020

(65) Prior Publication Data

US 2021/0044047 A1 Feb. 11, 2021

(30) Foreign Application Priority Data

Aug. 6, 2019 (DE) ..... 102019211762.7

(51) Int. Cl.

| | |
|---|---|
| ***H01R 13/17*** | (2006.01) |
| ***H01R 13/627*** | (2006.01) |
| ***H01R 13/187*** | (2006.01) |
| ***H01R 13/18*** | (2006.01) |

(52) U.S. Cl.

CPC ..... *H01R 13/17* (2013.01); *H01R 13/18* (2013.01); *H01R 13/187* (2013.01); *H01R 13/6273* (2013.01)

(58) Field of Classification Search

CPC ..... H01R 13/18

See application file for complete search history.

(56) References Cited

U.S. PATENT DOCUMENTS

| | | | |
|---|---|---|---|
| 6,102,752 | A | 8/2000 | Bommel et al. |
| 6,126,495 | A | 10/2000 | Lolic et al. |
| 7,387,550 | B2 | 6/2008 | Myer et al. |
| 7,419,410 | B2 | 9/2008 | Myer et al. |
| 10,886,664 | B2 * | 1/2021 | Sathianathan ..... H01R 13/521 |
| 2017/0047677 | A1 | 2/2017 | Bhagyanathan Sathianathan et al. |
| 2018/0212340 | A1 | 7/2018 | Bhagyanathan Sathianathan et al. |

FOREIGN PATENT DOCUMENTS

| | | | |
|---|---|---|---|
| DE | 19828984 | A1 | 12/1999 |
| DE | 102016125764 | A1 | 6/2018 |
| JP | 2013045566 | A | 3/2013 |
| WO | 2018136877 | A1 | 7/2018 |

OTHER PUBLICATIONS

German Office Action, Application No. 102019211762.7, dated Apr. 8, 2020.

* cited by examiner

*Primary Examiner* — Ross N Gushi

(74) *Attorney, Agent, or Firm* — MacMillan, Sobanski & Todd, LLC

(57) ABSTRACT

An electric terminal includes a contact portion that includes a contact box. A first contact arm extends from the contact box and is adapted to engage a corresponding terminal. The electric terminal also includes a spring portion with a first spring box that is located around a portion of the contact box. The spring portion also includes a second spring box that is located adjacent to the first spring box. The first spring box includes a first spring arm that engages the first contact arm. The second spring box includes a first guard that engages the first spring arm.

12 Claims, 5 Drawing Sheets

CLEAN BODY ELECTRIC TERMINAL

BACKGROUND OF THE INVENTION

This invention relates to an electric terminal. More specifically, this invention relates to a clean body electric terminal.

Miniature electric terminals are typically used in connectors to provide a large number of electric connections in a small space. An example of a miniature electric terminal is described in U.S. Pat. No. 6,126,495. The miniature electric terminal is a two-piece, female terminal that includes two contact arms that engage opposed sides of a plugged-in contact pin. Each of the contact arms engages the full width of the contact pin. Additionally, spring arms engage each of the contact arms and press the contact arms inwardly in order to increase the contact force between the contact arms and the contact pin. Each miniature electric terminal requires little space on either side thereof. As a result, a large number of miniature electric terminals can be placed adjacent to each other in a connector in a relatively small amount of space.

Conventional vehicles, such as passenger cars, have an increasing number of electric components and an increasing number of electric connections for these components. As a result, there is a desire to fit a larger number of electric connections in a limited amount of space. It would be advantageous to have an improved miniature electric terminal.

SUMMARY OF THE INVENTION

This invention relates to an electric terminal. The electric terminal includes a contact portion. The contact portion includes a contact box. A first contact arm extends from the contact box and is adapted to engage a corresponding terminal. The electric terminal also includes a spring portion. The spring portion includes a first spring box that is located around a portion of the contact box. The spring portion includes a second spring box that is located adjacent to the first spring box. The first spring box includes a first spring arm that extends from the first spring box and engages the first contact arm. The second spring box includes a first guard that extends from the second spring box and engages the first spring arm.

The electric terminal includes a contact portion. The contact portion includes a contact box. The contact box has a contact base and a contact outer wall that are located on opposed sides of a terminal axis. The contact portion includes a first contact arm that extends from the contact outer wall and is adapted to engage a corresponding terminal. The electric terminal also includes a spring portion. The spring portion includes a first spring box. The first spring box is located around a portion of the contact box. The spring portion includes a first spring arm that extends from the first spring box and engages the first contact arm. The spring portion also includes a second spring box that is located adjacent to the first spring box. A first guard extends from the second spring box and engages the first spring arm.

In other embodiments the electric terminal has a base portion including a contact box that is defined by a contact base, a first contact side wall, a second contact sidewall, and a contact outer wall. The first contact side wall extends from the contact base. The second contact sidewall also extends from the contact base. The contact outer wall extends from the second contact sidewall. The base portion includes a first contact arm and a second contact arm that extend from the contact box on opposed sides of a terminal axis. The first contact arm and the second contact arm are adapted to engage a corresponding terminal. The electric terminal also includes a spring portion. The spring portion has a first spring box that is located around a portion of the contact box. The first spring box is defined by a spring base, a first spring sidewall, a second spring sidewall, and a spring middle wall. The first spring sidewall extends from the spring base. The second spring sidewall also extends from the spring base. The spring middle wall extends from the second spring sidewall. The spring portion including a first spring arm that extends from the first spring box and engages the first contact arm. The spring portion also includes a second spring arm that extends from the first spring box and engages the second contact arm. The spring portion includes a second spring box that is defined by the first spring side wall, the spring middle wall, a spring outer wall, and a third spring sidewall. The spring outer wall extends from the first spring side wall. The third spring sidewall extends from the spring outer wall. The spring portion also includes a first guard that extends from the second spring box and engages the first spring arm.

In another embodiment of the electric terminal, the contact outer wall extends from the second contact sidewall and includes a free end that is proximate the first contact side wall. The first contact arm extends from the contact outer wall. The second contact arm extends from the contact base. The first spring arm extends from the spring middle wall. The second spring arm extends from the spring base. Also, the second spring box including a lock opening that is adapted to engage a terminal lock. The first guard is located in the lock opening.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
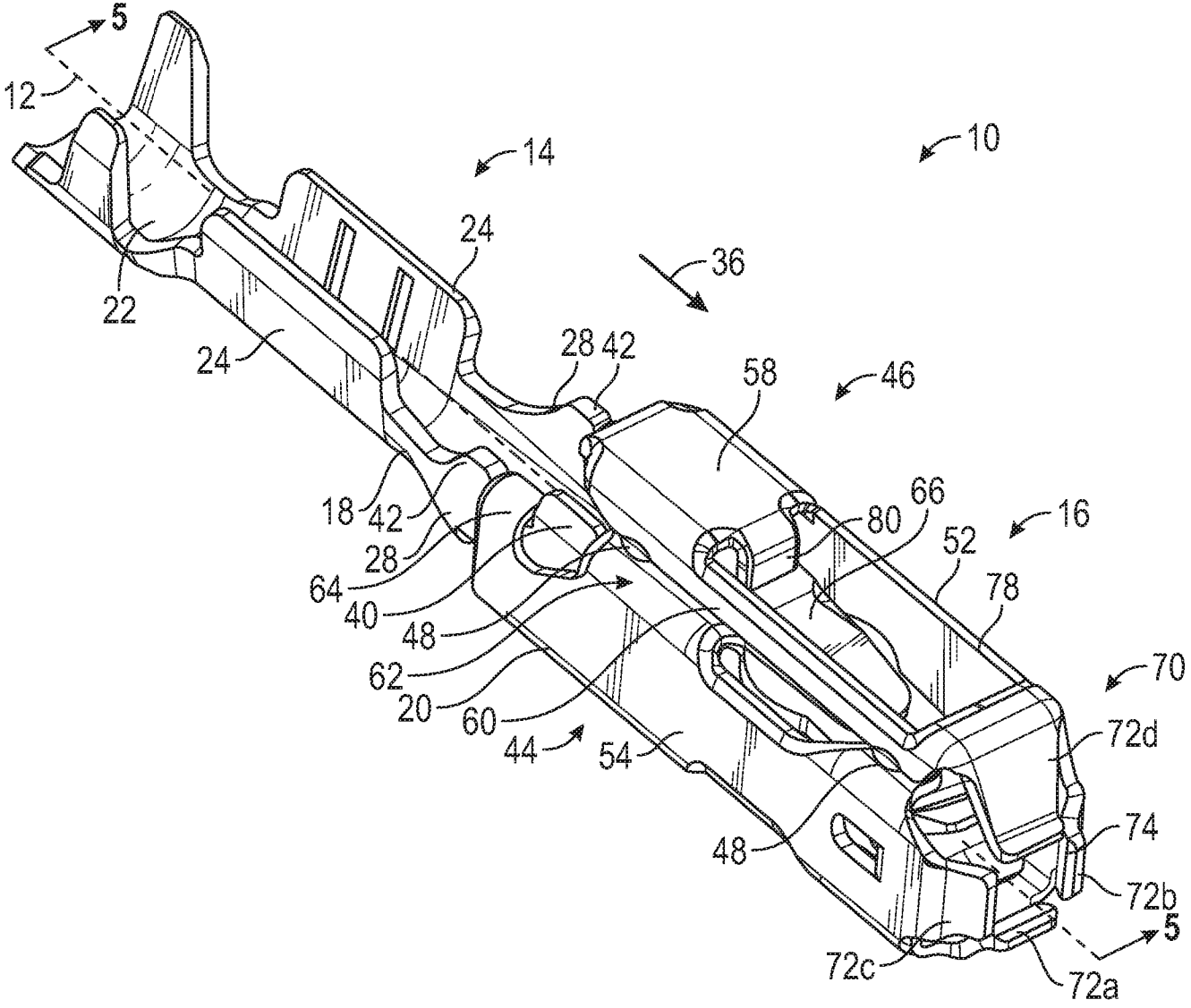
FIG. 1 is a front perspective view of an electric terminal.
Figure 2:
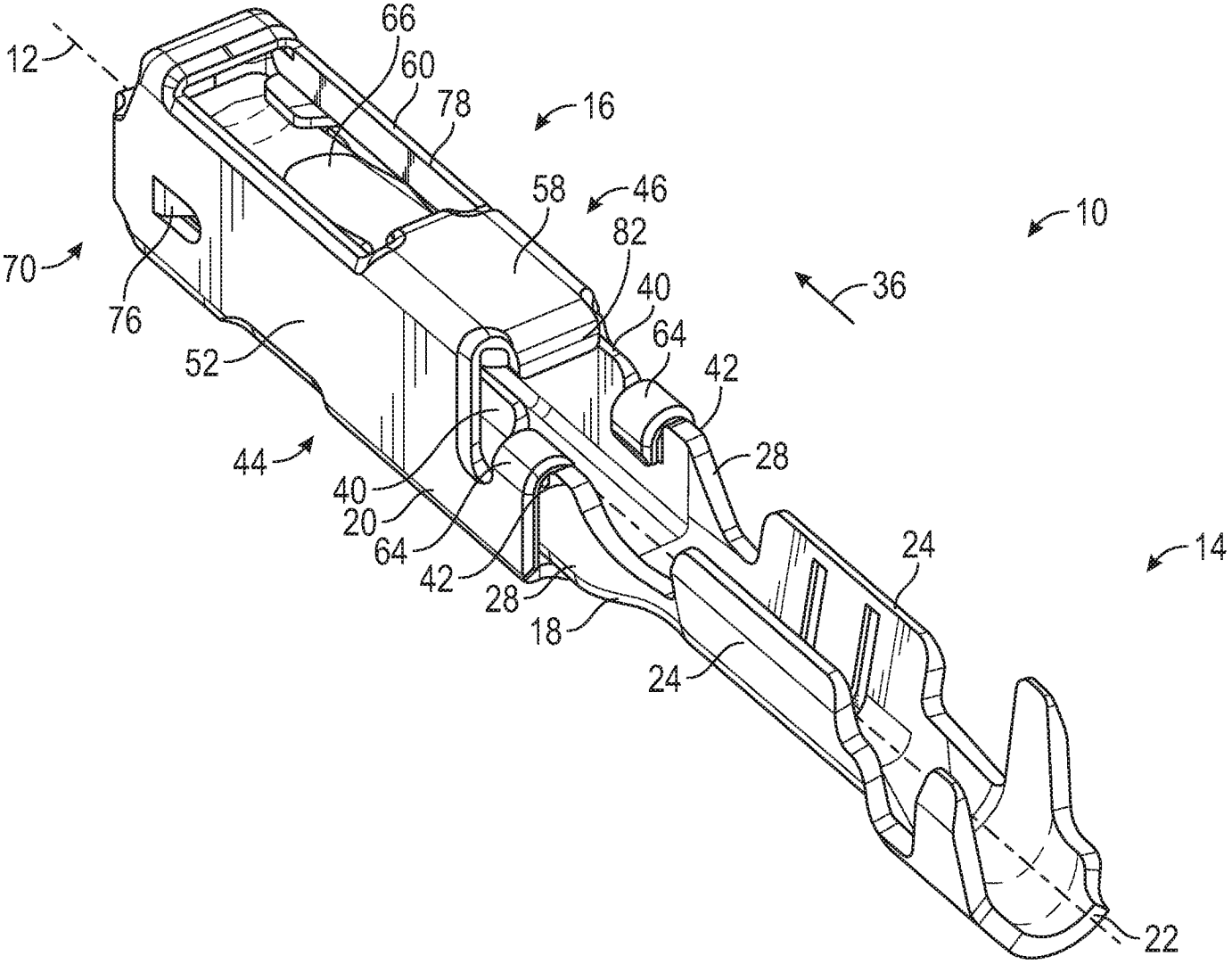
FIG. 2 is a rear perspective view of the electric terminal illustrated in FIG. 1.

Referring now to the drawings, there is illustrated in FIG. 1 a front perspective view of an electric terminal, indicated generally at 10. A rear perspective view of the electric terminal 10 is illustrated in FIG. 2. The illustrated electrical terminal 10 is a female electrical terminal, but may be any desired type of terminal. The electric terminal 10 is a clean body terminal that is adapted to be used in combination with a mat seal (not shown). Thus, the electric terminal 10 does not include any sharp edges or projections that can damage the mat seal when the electric terminal 10 is inserted through an opening in the mat seal.

The electric terminal 10 extends along a terminal axis 12 and includes a connection portion, indicated generally at 14, and a contact portion, indicated generally at 16. The connection portion 14 is adapted to connect to an electric conductor (not shown). The illustrated connection portion 14 is adapted to be crimped onto a wire (not shown), but the connection portion 14 may be any desired type of connection. The contact portion 16 is adapted to mate with a male corresponding terminal (not shown) that can be inserted along the terminal axis 12.

Figure 3:
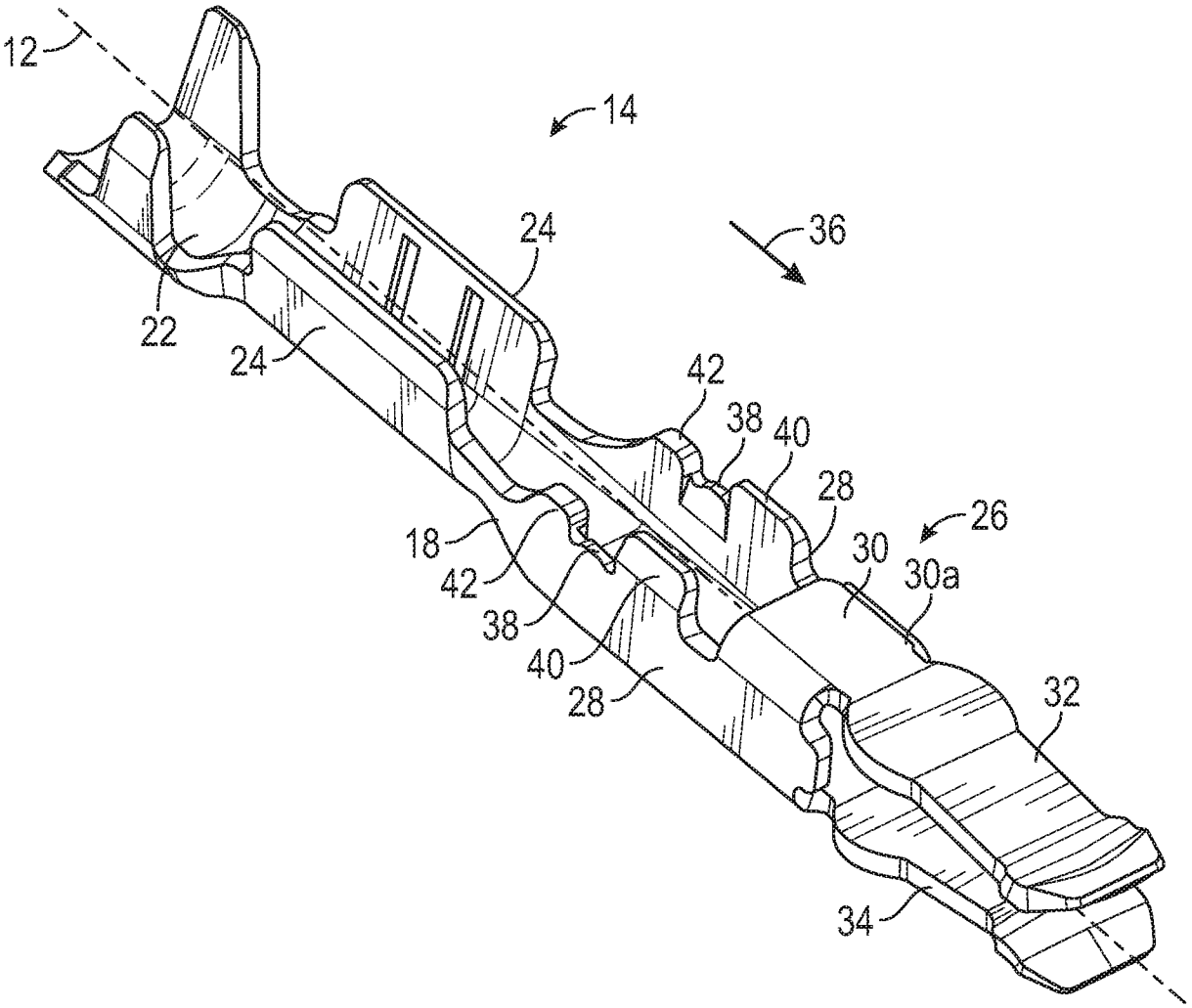
FIG. 3 is a front perspective view of a contact member of the electric terminal.

The electrical terminal 10 is a two-piece construction and includes a contact member 18 and a spring member generally at 20. Referring to FIG. 3, the contact member 18 is shown without the spring member 20. The illustrated contact member 18 is made of copper, but may be made of any desired material. The illustrated contact member 18 is stamped from sheet metal and folded into the illustrated shape, but may be made by any desired process.

The contact member 18 includes a contact base 22 that extends along the terminal axis 12. In the illustrated embodiment, the connection portion 14 is a part of the contact member 18, and a pair of crimp tongues 24 extend from the contact base 22. In the contact portion 16, the contact member 18 includes two contact side walls 28 that extend from the contact base 22 on opposed sides of the terminal axis 12. The contact member 18 includes a contact box, indicated generally at 26. The contact box 26 includes a portion of the contact base 22, portions of each of the contact side walls 28, and a contact outer wall 30. The contact outer wall 30 extends from one of the contact side walls 28 toward the other of the contact side walls 28 and is located on the opposite side of the terminal axis 12 from the contact base 22. In the illustrated embodiment, the contact outer wall 30 extends from one contact side wall 28 toward the other contact side wall 28, but does not engage both contact side walls 28.

The contact member 18 includes a first contact arm 32 and a second contact arm 34 that extend from the contact box 26 in a contact direction 36. In the illustrated embodiment, the contact direction 36 is parallel to the terminal axis 12, but it may have any desired orientation. The contact arms 32 and 34 are located on opposed sides of the terminal axis 12. The first contact arm 32 extends from the contact outer wall 30, while the second contact arm 34 extends from the contact base 22. The contact arms 32 and 34 are bent toward each other and include respective contact areas 32*a* and 34*a* that engage the corresponding male terminal when the electric terminal 10 is mated therewith. In the illustrated embodiment, the second contact arm 34 extends at a greater angle relative to the terminal axis 12 than does the first contact arm 32.

The contact member 18 includes features to properly position the spring member 20 and retain the spring member 20 in position when the electric terminal 10 is assembled. The contact member 18 includes a guide notch 38 provided in each of the contact side walls 28, at the side of the respective contact side wall 28 that is away from the contact base 22. Each of the guide notches 38 is adjacent to a forward guide 40 that extends farther from the contact base 22 than the guide notch 38. Each forward guide 40 is located in the contact direction 36 from the respective guide notch 38. Each of the guide notches 38 is also adjacent to a rearward guide 42 that extends farther from the contact base 22 than the guide notch 38. Each rearward guide 42 is located opposite the contact direction 36 from the respective guide notch 38. The purpose of the guide notches 38 will be described below.

Referring back to FIG. 1 and FIG. 2, the spring member 20 is illustrated attached to the contact member 18. The illustrated spring member 20 is made of stainless steel, but may be made of any desired material. The illustrated spring member 20 is stamped and folded into the illustrated shape, but may be made by any desired process. The illustrated spring member 20 is held in the illustrated shape by two welds 48, but may include any desired fastener.

Figure 4:
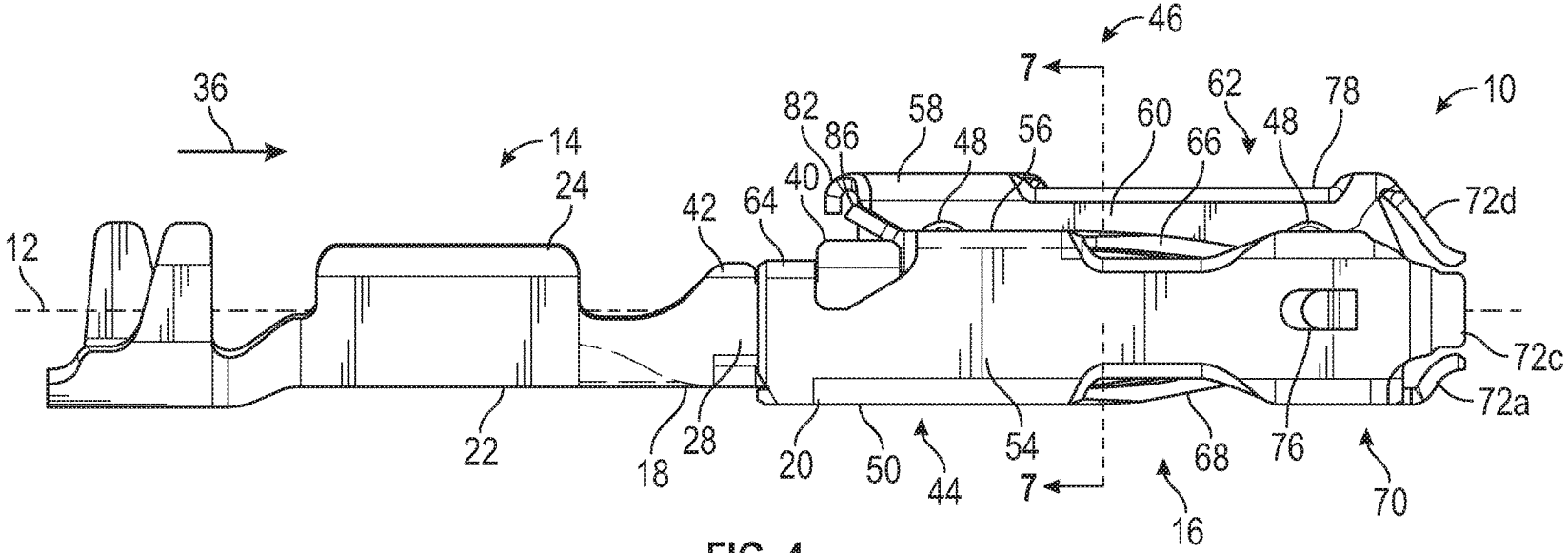
FIG. 4 is a side view of the electric terminal illustrated in FIG. 1.
Figure 5:
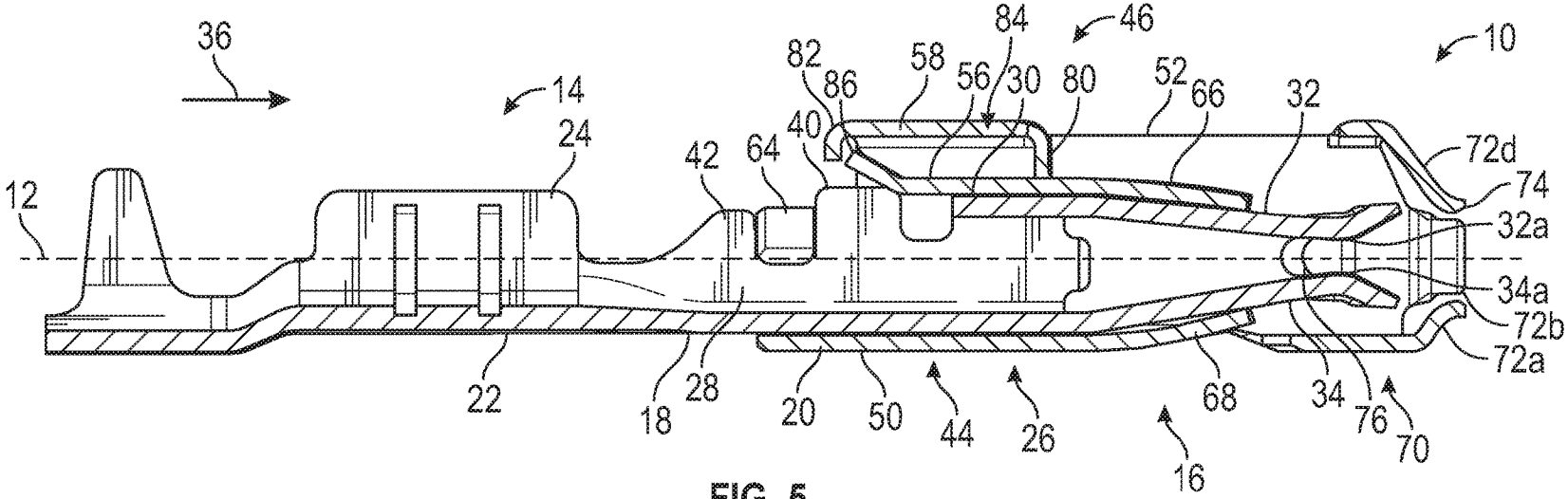
FIG. 5 is a cross-sectional view taken along the line 5-5 of FIG. 1.
Figure 7:
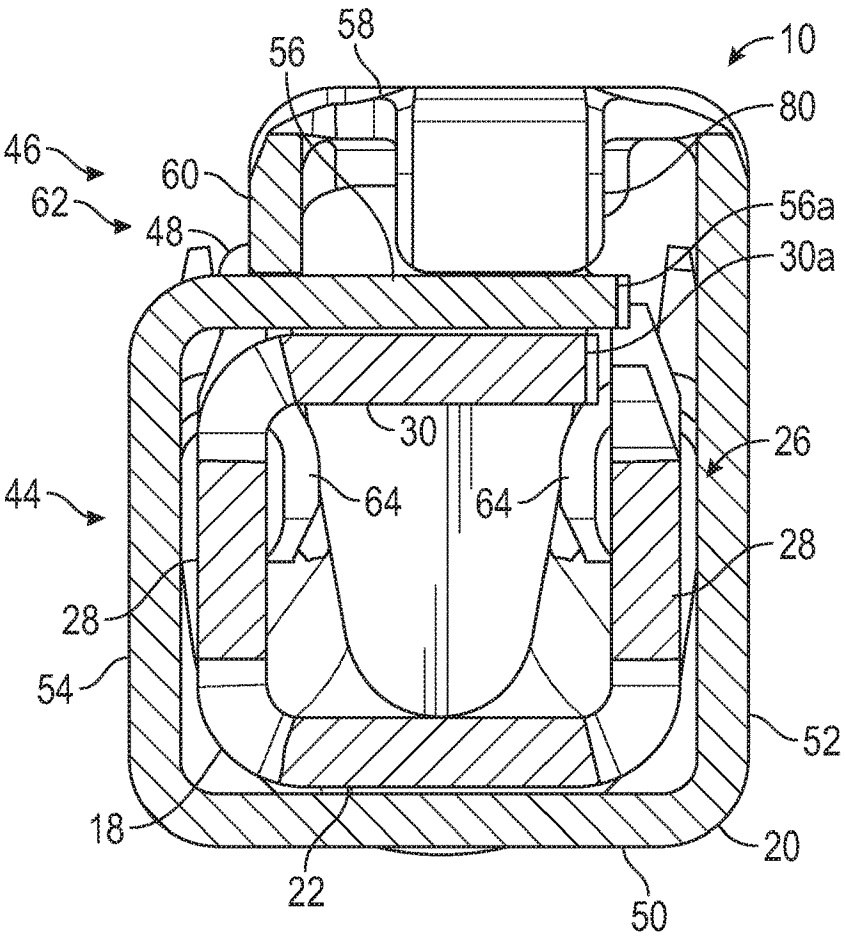
FIG. 7 is a cross-sectional view taken along the line 7-7 of FIG. 4.
Figure 6:
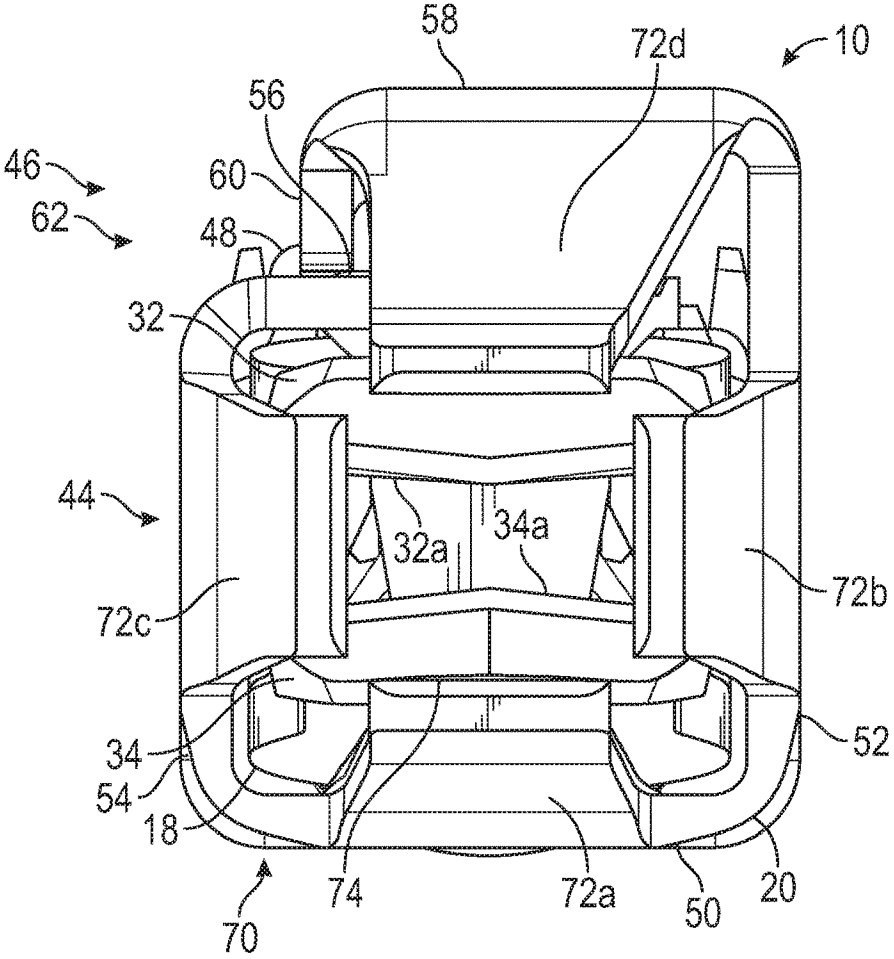
FIG. 6 is a front end elevational view of the electric terminal illustrated in FIG. 1.

FIG. 4 is a side elevational view of the electric terminal 10, and FIG. 5 is a cross-sectional view taken along the line 5-5 of FIG. 1 taken along the terminal axis 12. FIG. 6 is a front end elevational view of the electric terminal 10, and FIG. 7 is cross-sectional view taken along the line 7-7 of FIG. 4. The features of the spring member 20 will be described in reference to these figures.

The spring member 20 includes a first spring box, indicated generally at 44, that is located around part of the contact member 18. The first spring box 44 is located around a portion of the contact box 26, and the terminal axis 12 passes through the first spring box 44. The spring member 20 also includes a second spring box, indicated generally at 46, that is located adjacent to the first spring box 44.

As best shown in FIG. 7, the spring member 20 includes a spring base 50 that is located at least partially adjacent to the contact base 22. The spring base 50 defines a first side of the first spring box 44. A portion of the spring member 20 is folded to create a first spring side wall 52. The illustrated first spring side wall 52 is folded from the spring base 50 and extends generally perpendicular to the spring base 50. The first spring side wall 52 is located at least partially adjacent to one of the contact side walls 28 and defines a second side of the first spring box 44. Another portion of the spring member 20 is folded to create a second spring side wall 54. The illustrated second spring side wall 54 is folded from the spring base 50 and extends generally perpendicular to the spring base 50. The second spring side wall 54 is located on the opposite side of the terminal axis 12 from the first spring side wall 52. The second spring side wall 54 is located at least partially adjacent to another one of the contact side walls 28 and defines a third side of the first spring box 44. Additionally, a portion of the spring member 20 is folded to create a spring middle wall 56. The illustrated spring middle wall 56 is folded from the second spring wall 54 and extends generally parallel to the spring base 50. The spring middle wall 56 is located on the opposite side of the terminal axis 12 from the spring base 50. The spring middle wall 56 is located at least partially adjacent to the contact outer wall 30 one of the contact side walls 28 and defines a fourth side of the first spring box 44. In the illustrated embodiment, the spring middle wall 56 extends toward the first spring side wall 52 but does not engage the first spring side wall 52. The spring middle wall 56 includes a free end 56*a* that is located near the first spring side wall 52, but is not connected to the other of the first spring side wall 52.

As also best shown in FIG. 7, the first spring side wall 52 extends farther than from the spring base 50 than the second spring side wall 54 does, and the first spring side wall 52 defines a first side of the second spring box 46. Additionally, a portion of the spring member 20 is folded to create a spring outer wall 58. The illustrated spring outer wall 58 is folded from the first spring side wall 52 and extends generally parallel to the spring base 50. The spring middle wall 56 is located between the spring outer wall 58 and the terminal axis 12. The spring outer wall 58 defines a second side of the second spring box 46. Further, a portion of the spring member 20 is folded to create a third spring side wall 60. The illustrated third spring side wall 60 is folded from the spring outer wall 58 and extends generally perpendicular to the spring base 50. The third spring side wall 60 is located on the opposite side of the terminal axis 12 from the first spring side wall 52. The third spring side wall 60 defines a third side of the second spring box 46. In the illustrated embodiment, the third spring side wall 60 extends toward the spring middle wall 56 and is attached to the spring middle wall 56 by the welds 48.

In the illustrated embodiment, the spring outer wall 58 is shorter than the spring base 50 in a lateral direction, as viewed in FIG. 7. As a result, the second spring box 46 has a smaller lateral size than the first spring box 44 and a longitudinal notch, indicated generally at 62, extends parallel to the terminal axis 12 adjacent to the first spring box 44 and the second spring box 46. The notch 62 serves as an orientation feature that limits the orientation of the electric terminal 10 when it is inserted into an electric connector (not shown).

As previously described and as shown in FIG. 7, the illustrated contact box 26 includes the contact outer wall 30 that is connected to only one of the contact side walls 28. The contact outer wall 30 is folded from one of the contact side walls 28 and includes a free end 30*a* that is located near the other of the contact side walls 28, but is not connected to the other of the contact side walls 28. When the electric terminal 10 is mated with the corresponding electric terminal, the contact arms 32 and 34 are pushed apart, and the contact outer wall 30 is biased away from the contact base 22. This could deform the contact box 26, but the first spring box 44 located around the contact box 26 will maintain the shape of the contact box 26. Thus, the spring member 20 serves as a support for maintaining the shape of the electric terminal 10.

As best shown in FIG. 2, the first spring side wall 52 and the second spring side wall 54 each include guide tongues 64 that are folded over the contact side walls 28. Each of the guide tongues 64 is located in one of the guide notches 38. Each of the guide tongues 64 is located between one of the forward guides 40 and one of the rearward guides 42. This properly positions the spring member 20 relative to the contact member 18 during assembly of the electric terminal 10 and maintains the spring member 20 and the contact member 18 in a desired relative position.

As best shown in FIG. 5, the spring member 20 includes a first spring arm 66 and a second spring arm 68. The first spring arm 66 extends from the spring middle wall 56 and engages the first contact arm 32 while the second spring arm 68 extends from the spring base 50 and engages the second contact arm 34. The spring arms 66 and 68 bias the respective contact arms 32 and 34 toward the terminal axis 12. In the illustrated embodiment, the second spring arm 68 extends at a greater angle relative to the terminal axis 12 than does the first spring arm 66.

As best shown in FIG. 5, the spring member 20 extends farther in the contact direction 36 than does the contact member 18. The spring member 20 includes a shroud, indicated generally at 70, that protects the contact arms 32 and 34. The shroud 70 includes tapered wall sections 72*a* through 72*d* that define a plug-in opening 74. The terminal axis 12 passes through the plug-in opening 74, and the plug-in opening 74 helps guide the corresponding terminal into proper engagement with the contact arms 32 and 34. The illustrated plug-in opening 74 has a generally rectangular shape when viewed perpendicular to the terminal axis 12 (as shown in FIG. 6), but may have any desired shape.

The tapered wall section 72*a* extends from the spring base 50, the tapered wall section 72*b* extends from the first spring side wall 52, the tapered wall section 72*c* extends from the second spring side wall 54, and the tapered wall section 72*d* extends from the spring outer wall 58. The tapered wall sections 72*a*, 72*b*, and 72*c* extend from the first spring box 44 and are generally the same size, while the tapered wall section 72*d* extends from the second spring box 46 and is larger. However, the tapered wall sections 72*a* through 72*d* may have any desired relative sizes.

As best shown in FIG. 4 and FIG. 5, the spring member 20 includes two spacers 76 that extend between the contact arms 32 and 34. The spacers 76 extend respectively from the first spring side wall 52 and the second spring side wall 54 toward the terminal axis 12. The illustrated spacers 76 are located adjacent to the contact areas 32*a* and 34*a*, but may be in any desired location. The spacers 76 engage the contact arms 32 and 34 in order to maintain a minimum separation between them, and further to provide lateral guides for the corresponding electric terminal.

As best shown in FIG. 1, the electric terminal 10 includes a lock opening 78. The illustrated lock opening 78 is defined in the second spring box 46 and includes a cut-out in the spring outer wall 58, but the lock opening 78 may be in any desired location. The lock opening 78 is adapted to accommodate a terminal lock (not shown) on the electric connector that can retain the electric terminal 10 in the electric connector.

The second spring box 46 includes a first guard 80 that extends from the spring outer wall 58 in the contact direction 36. The first guard 80 extends into the lock opening 78 and is bent toward the terminal axis 12. The first guard 80 engages the first spring arm 66 and biases the first spring arm 66 toward the terminal axis 12. The second spring box 46 also includes a second guard 82 that extends from the spring outer wall 58 opposite the contact direction 36. The second guard 82 extends toward the connection portion 14 and is bent toward the terminal axis 12.

The first guard 80 and the second guard 82 provide curved surfaces on opposed sides of the spring outer wall 58 in the contact direction 36. These serve to prevent damage to the mat seal during insertion of the electric terminal 10. Additionally, the first guard 80 serves to increase the contact force between the first contact arm 32 and the corresponding connector.

As best shown on FIG. 5, the electric terminal 10 includes an interior space, indicated generally at 84, that is defined by the spring outer wall 58, the first guard 80, and the second guard 82. A distal end 86 of the spring middle wall 56 is bent away from the terminal axis 12 and is located in the interior space 84. The distal end 86 is located opposite the contact direction 36. This further helps prevent damage to the mat seal during insertion of the electric terminal 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric terminal comprising:

a contact member including a contact box and a contact arm extending from the contact box that is adapted to engage a terminal; and a spring member including a first spring box that is located around a portion of the contact box and a second spring box that is located adjacent to the first spring box, wherein the first spring box includes a spring arm that extends from the first spring box and engages the contact arm, and the second spring box includes a guard that extends from the second spring box and engages the first spring box.

2. The electric terminal of claim 1, wherein the contact box includes a contact base, a contact outer wall, and a contact side wall that connects the contact base and the contact outer wall.

3. The electric terminal of claim 2, wherein the contact outer wall has a free end.

4. The electric terminal of claim 1, wherein the electric terminal is a clean body electric terminal.

5. The electric terminal of claim 1, wherein the contact arm is a first contact arm, and wherein the contact member further includes a second contact arm extending from the contact box that is adapted to engage the terminal.

6. The electric terminal of claim 5, wherein the spring arm is a first spring arm, and wherein the first spring box includes a second spring arm that extends from the first spring box and engages the second contact arm.

7. The electric terminal of claim 6, wherein the contact outer wall has a free end.

8. The electric terminal of claim 5, wherein the electric terminal is a clean body electric terminal.

9. The electric terminal of claim 1, wherein the second spring box is shorter than the first spring box in a lateral direction defining a longitudinal notch that extends parallel to the terminal axis.

10. The electric terminal of claim 1, wherein the second spring box includes a lock opening that is adapted to engage a terminal lock.

11. The electric terminal of claim 10, wherein the guard is located in the lock opening.

12. The electric terminal of claim 11, wherein the guard is a first guard, and further including a second guard that extends from the second spring box toward the terminal axis.

* * * * *